US009450314B2

(12) United States Patent
Braun et al.

(10) Patent No.: US 9,450,314 B2
(45) Date of Patent: Sep. 20, 2016

(54) ELECTRICAL CONTACT-MAKING SYSTEM

(71) Applicant: WIELAND ELECTRIC GMBH, Bamberg (DE)

(72) Inventors: Meinrad Braun, Regensburg (DE); Thomas Mueller, Zapfendorf (DE)

(73) Assignee: Wieland Electric GmbH, Bamberg (DE)

( * ) Notice: Subject to any disclaimer, the term of this patent is extended or adjusted under 35 U.S.C. 154(b) by 96 days.

(21) Appl. No.: 14/183,875

(22) Filed: Feb. 19, 2014

(65) Prior Publication Data

US 2014/0235094 A1 Aug. 21, 2014

(30) Foreign Application Priority Data

Feb. 19, 2013 (DE) ..... 10 2013 002 740

(51) Int. Cl.

| | |
|---|---|
| ***H01B 7/00*** | (2006.01) |
| ***H01R 4/24*** | (2006.01) |
| ***H01R 12/67*** | (2011.01) |
| ***H01R 13/52*** | (2006.01) |
| *H01B 7/08* | (2006.01) |

(52) U.S. Cl.

CPC ..... *H01R 4/2404* (2013.01); *H01R 12/67* (2013.01); *H01R 13/5205* (2013.01); *H01B 7/0823* (2013.01)

(58) Field of Classification Search

USPC .. 174/110 R, 113 R, 117 R, 117 F, 74 R, 78, 174/58, 59, 84 R, 72 C

See application file for complete search history.

(56) References Cited

U.S. PATENT DOCUMENTS

| | | | | |
|---|---|---|---|---|
| 3,444,506 | A * | 5/1969 | Wedekind | H01R 12/675 439/405 |
| 3,720,778 | A * | 3/1973 | Woertz | H01R 4/2483 174/117 F |
| 3,728,424 | A * | 4/1973 | Bauer | B29C 47/027 174/117 F |
| 4,209,219 | A * | 6/1980 | Proietto | H01R 12/675 439/405 |
| 5,190,468 | A * | 3/1993 | Nichols, III | H01R 4/2404 439/404 |
| 6,027,367 | A * | 2/2000 | Woertz | H01R 4/2483 174/59 |
| 6,196,863 | B1 * | 3/2001 | Schwant | H01R 12/67 439/417 |
| 6,444,910 | B1 * | 9/2002 | Goto | H01R 4/70 174/117 F |
| 6,551,124 | B1 * | 4/2003 | Gossmann | H01R 13/5219 439/411 |
| 6,648,672 | B1 * | 11/2003 | Meinke | H01R 4/2433 439/380 |
| 7,667,140 | B2 * | 2/2010 | Hock | H01B 7/0876 174/117 F |
| 2004/0115984 | A1 * | 6/2004 | Rudy | F21V 21/002 439/405 |
| 2007/0264866 | A1 * | 11/2007 | Oesterhaus | H01R 12/772 439/493 |
| 2011/0247875 | A1 | 10/2011 | Onodi | |
| 2011/0247877 | A1 * | 10/2011 | Onodi | H01B 7/295 174/70 R |

FOREIGN PATENT DOCUMENTS

| | | | |
|---|---|---|---|
| DE | 7330510 | U | 11/1973 |
| DE | 9101065 | U1 | 4/1991 |
| DE | 19741603 | A1 | 3/1999 |
| DE | 102006039604 | A1 | 2/2008 |
| DE | 102010014530 | A1 | 10/2011 |
| EP | 0496970 | A1 | 8/1992 |
| WO | 0122534 | A1 | 3/2001 |
| WO | 2010040159 | A1 | 4/2010 |

* cited by examiner

*Primary Examiner* — William H Mayo, III
(74) *Attorney, Agent, or Firm* — Laurence A. Greenberg; Werner H. Stemer; Ralph E. Locher

(57) ABSTRACT

An electrical contact-making system includes a flat ribbon cable with a sheath which has a planar top sheath face, a core plane containing electrical cores and a bottom sheath face with constricted portions which are parallel to the cores and are each disposed between two of the cores. A tapping collar makes electrical contact with the cores. A peripheral sealing strip encloses a rectangular contact-making region and is disposed on a bottom face of the top part of the tapping collar facing the top sheath face of the flat ribbon cable.

11 Claims, 2 Drawing Sheets

ELECTRICAL CONTACT-MAKING SYSTEM

CROSS-REFERENCE TO RELATED APPLICATION

This application claims the priority, under 35 U.S.C. §119, of German Patent Application DE 10 2013 002 740.3, filed Feb. 19, 2013; the prior application is herewith incorporated by reference in its entirety.

BACKGROUND OF THE INVENTION

Field of the Invention

The present invention relates to an electrical contact-making system.

Such a contact-making system is known, for example, from German Patent Application DE 10 2006 039 604 A1, corresponding to U.S. Pat. No. 7,667,140 B2. In that known contact-making system, contact is made with a flat ribbon cable, which has grooves on both sides, with the aid of piercing contacts in accordance with the insulation-piercing method. To that end, the piercing contacts are fastened to the cover of a multipartite housing. The housing is aligned with special markings on the grooved cable and then closed.

SUMMARY OF THE INVENTION

It is accordingly an object of the invention to provide an electrical contact-making system, which overcomes the hereinafore-mentioned disadvantages of the heretofore-known systems of this general type, which increases the operating temperature range of such a contact-making system and which, at the same time, improves the impermeability of the contact-making system.

With the foregoing and other objects in view there is provided, in accordance with the invention, an electrical contact-making system, comprising a flat ribbon cable with a sheath which has a planar top sheath face, a core plane containing electrical cores and a bottom sheath face with constricted portions, which are parallel to the cores, between in each case two cores, and having a tapping collar for making electrical contact with the cores, wherein a peripheral sealing strip, which encloses a rectangular contact-making region, is disposed on the bottom face of the top part, which faces the top sheath face of the flat ribbon cable, of the tapping collar.

Some of the dependent claims relate to advantageous developments of the invention and some relate to developments of the invention which are inventive themselves.

The invention is based on the consideration that the configuration of the sheathing of the flat ribbon cable is important for a particularly impermeable and reliable insulation-piercing contact-making process which is resistant to environmental influences. If, in this case, contact is made with the cores in a tapping collar from one side, this contact-making side of the flat ribbon cable and the opposite side fulfill different functions and should accordingly also meet different requirements. A high target accuracy and impermeability is desirable on the contact-making side on which the contact-making devices or screws are pushed through the insulating sheath and therefore pierce the sheath. Contact should be made with the cores in as central a position as possible. The resulting contact points should be well-protected against environmental influences. However, on the other side of the flat ribbon cable which is situated opposite the contact-making devices to a certain extent, it is desirable for environmental and material influences to have as little effect as possible on the contact-making process. At the same time, where possible, an attempt should be made to avoid mutual displacement of the cores of the flat ribbon cable in relation to the contact devices. Conventional flat ribbon cables, which are either of planar or corrugated construction on both sides, meet the requirements only to an insufficient extent.

As has now been identified, a flat ribbon cable which meets the abovementioned requirements can be realized by that side on which contact is intended to be made with the cores being of planar construction, and by the other side of the flat ribbon cable having grooves or constricted portions, that is to say substantially points of lower thickness of the sheathing. By virtue of the planar configuration and the sheath shape which is therefore flat over the contact-making side, the contact devices are in each case inserted perpendicular to the sheath surface, so that deformation of or stress on the material is kept low and target accuracy is achieved. At the same time, the contact-making points on a planar surface are easier to seal off than on a corrugated surface. The influence of the softening of the material of the sheathing and of the insulation is reduced, in particular at relatively high temperatures, by reducing the thickness of the sheathing in the region between the cores on the other side. If the cable is inserted into a tapping collar of which the shaping in the receiving region corresponds to the corrugated structure of the flat ribbon cable by virtue of molded receiving recesses, the cores are also centered and/or guided as desired, and therefore displacement in relation to the contact devices is kept low.

In order to seal off the contact-making points of the cores, a rectangular, peripheral sealing strip is provided on the bottom face of the tapping collar top part. The sealing strip firstly runs parallel to the outer edges of the inserted flat ribbon cable and spans the flat ribbon cable in two areas which are spaced apart in the longitudinal direction. A rectangular contact-making region which is enclosed by the sealing strip is formed on the tapping collar top part in this way. When the tapping collar is closed by the fastening screws of the closure apparatus being tightened, the peripheral sealing strip is pressed such that sufficient sealing of the contact-making region in relation to the outside and therefore to external influences, in particular environmental influences, is realized.

The bottom sheath face of the flat ribbon cable advantageously has a wave-form contour in which the wave troughs are formed by grooves. In this case, the contour of the bottom sheath face runs between the grooves, preferably in the manner of a segment of a circle, with an imaginary circle center point in the center point of the respective core, as seen in cross section. In this case, the segments of a circle particularly preferably span an angular region of less than 180°, and therefore a sufficient sheath thickness is still realized between the cores. A configuration of this kind allows the flat ribbon cable to be supported by supporting forces, which are directed radially inward in the region of the core, when the flat ribbon cable is embedded in a tapping collar with a receiving region which is congruent to the bottom sheath face with respect to shape. This notably has the result that, during the contact-making process, the core does not slip laterally in relation to the respective contact devices.

In order to realize mechanical coding, the outer sheath faces of the flat ribbon cable are advantageously of asymmetrical shaping, and therefore direction-dependent connection is possible. This is advantageous, for example, when the cores are constructed for different currents or types of transmission and serves generally for clear assignment of the cores to the individual contact-making points.

The cores of the flat ribbon cable are preferably individually electrically insulated. In an alternative refinement, groups of adjacent cores or else all of the cores can be embedded in a common insulation.

The flat ribbon cable preferably has 2 to 10, in particular 5, cores.

The tapping collar advantageously has a number of contact-making devices for an insulation-piercing contact-making process which corresponds to the number of cores. The contact-making devices are preferably constructed as screws.

In a preferred embodiment, the tapping collar has a two-part construction with a top part and a bottom part, wherein the top part has a receiving region which is congruent to the top sheath face with respect to shape, and the bottom part has a receiving region which is congruent to the bottom sheath face with respect to shape. Firstly, particularly good sealing between tapping collar and flat ribbon cable is achieved by virtue of this configuration. Secondly, contact can be made in a particularly stable and positionally accurate manner in this way.

The top part and the bottom part are preferably constructed with respect to their shaping in such a way that the flat ribbon cable is received in an interlocking manner by the parts only in a defined position. As a result, mechanical coding can be achieved and ensured in that contact is made with the cores with the desired alignment of the flat ribbon cable.

A closure apparatus for fastening top part and bottom part to one another, in particular in a releasable manner, is advantageously provided. In this way, the flat ribbon cable can initially be placed in the tapping collar and precisely positioned, before the collar is closed and the contact-making devices are routed through sheath and insulation.

The advantages of the invention are, in particular, that, due to the planar top sheath face, good sealing properties are achieved after contact is made. The lines or cores are supported against the contact pressure of the contact-making screws by virtue of the corrugated construction of the bottom sheath face, as a result of which the lines or cores are held laterally in position, so that contact is made in a reliable manner. In this way, the flat ribbon cable combines the advantageous properties of the two profiles, planar and corrugated. The influence of the softening of the material of the insulation and of the sheathing at relatively high temperatures is reduced due to the corrugation of the bottom sheath face and the sheath thickness which is reduced in this way. The result is precise placement of the conductors in relation to the contact-making screws in an insulation-piercing contact-making process, while at the same time realizing a high level of impermeability.

High currents are possible at the contact-making points due to contact being made in a position ally accurate and stable manner. A direction-dependent connection is possible by virtue of mechanical coding of the flat ribbon cable.

Other features which are considered as characteristic for the invention are set forth in the appended claims.

Although the invention is illustrated and described herein as embodied in an electrical contact-making system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
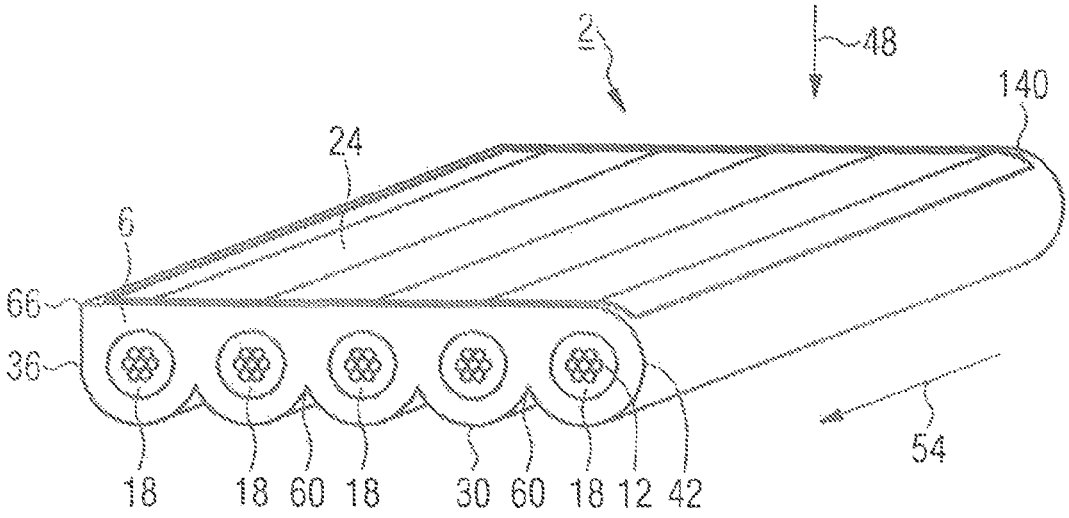
FIG. 1 is a highly-diagrammatic, perspective view of a preferred embodiment of a flat ribbon cable, sectioned at the front.

Referring now in detail to the figures of the drawings, in which identical parts are provided with the same reference symbols, and first, particularly, to FIG. 1 thereof, there is seen a flat ribbon cable 2 which has a sheath 6 or a sheathing in which five electrical cores 12 are disposed or embedded substantially in a common plane, wherein the cores 12 are each separately enclosed by an electrical insulation 18. The sheath 6 has a top sheath face 24 and a bottom sheath face 30 which are oriented substantially parallel to one another and parallel to the plane in which the cores 12 are disposed. The flat ribbon cable 2 also has two outer sheath faces 36, 42 which are each situated at the boundary regions of the flat ribbon cable 2 between top sheath face 24 and bottom sheath face 30. The flat ribbon cable 2 is suitable, for example, for an insulation-piercing contact-making process in which contact elements for making contact with the cores 12 are each routed through sheath 6 and insulation 18 in a contact-making direction 48 perpendicular to a longitudinal direction 54 of the cores 12. In this case, the sheath 6 is composed of materials such as ethylene vinyl acetate, polyvinyl chloride, cross-linked polyethylene, polyolefin compound, and also halogen-free plastic.

The illustration in FIG. 1 also shows a peripheral sealing strip 140. The sealing strip 140 runs along the outer sheath faces 36, 42 and extends over the flat ribbon cable 2 at two points. In the illustration in FIG. 1, these are the respective end sides of the illustrated cable section of the flat ribbon cable 2. In this way, the peripheral sealing strip 140 encloses a rectangular contact-making region of the flat ribbon cable 2.

The flat ribbon cable 2 is constructed in such a way that it has a high level of impermeability in relation to the environment after contact is made, and at the same time is insensitive to environmental influences. To this end, the top sheath face 24 has a planar construction, that is to say it has a flat or planar configuration and accordingly does not follow the shaping of the round cores 12 and their insulation 18.

In contrast, the bottom sheath face 30 has a substantially wave-form construction with grooves 60 between in each case two cores 12. That is to say, the contour of the bottom sheath face 30 follows the contour of the cores 12, which are of round cross section, or the insulation 18 which surrounds the cores in each case, in regions (in the manner of a segment of a circle). In order to ensure that the sheath thickness does not decrease excessively in the region of the grooves 60, the segments of a circle each cover an angular region of less than 180°. The corrugation on the bottom sheath face 30 reduces the sheath thickness of the flat ribbon cable in the region between two cores 12 in each case. The influence of the softening of the material of insulation 18 and sheath 6 at relatively high temperatures is reduced by virtue of the grooved bottom sheath face 30.

Furthermore, the flat ribbon cable 2 has mechanical coding. The mechanical coding is configured in such a way that the outer contours of the two outer sheath faces 36, 42 are of different construction. Whereas the outer sheath face 42 is in the form of a semicircle and merges with top sheath face 24 and bottom sheath face 30 in a manner which is fluid to a certain extent, the outer sheath face 36 has a corner or right-angled edge 66 at its transition to the top sheath face 24. The transition of the outer sheath face 36 to the bottom sheath face 30 is constructed as in the case of the outer sheath face 42. The outer sheath face 36 runs in a straight or planar manner between the transition and the edge 66. By virtue of this different shaping of the outer sheath faces 36, 42, a defined orientation of the flat ribbon cable in relation to an apparatus into which the flat ribbon cable is inserted, in particular an apparatus for making contact with the cores 12, can be defined in relation to the apparatus. This is advantageous, for example, when the various cores 12 of the flat ribbon cable are constructed differently for different transmission purposes or with respect to the material properties or loadability thereof and therefore it is possible to ensure that the correct cores 12 are selected for the contact-making process.

Figure 2:
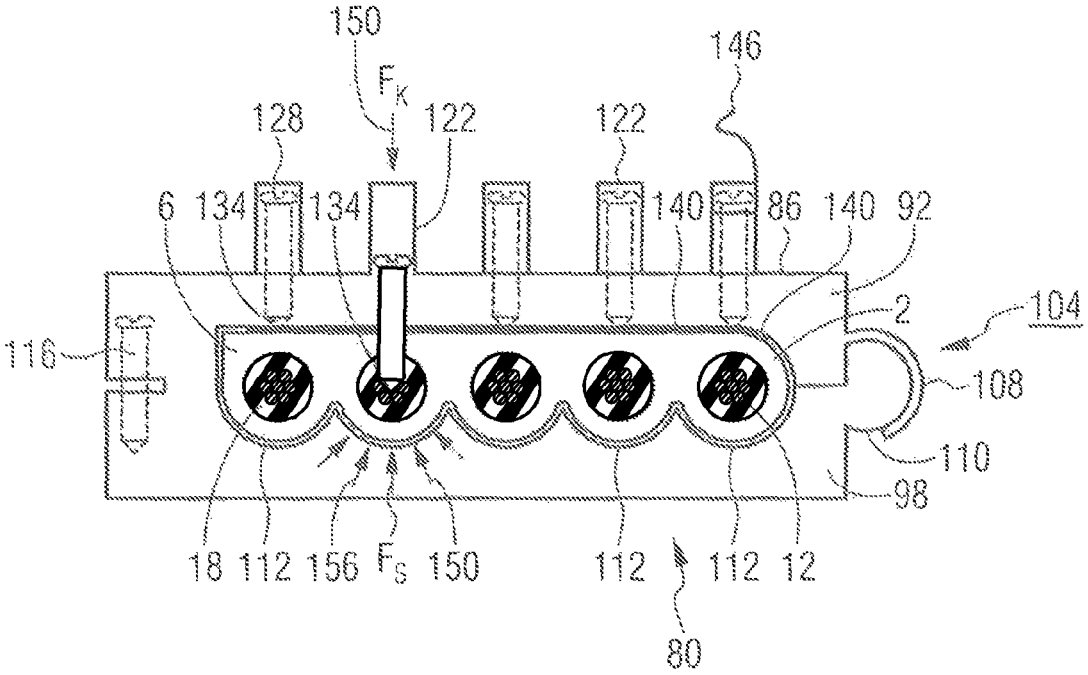
FIG. 2 is a highly-diagrammatic, cross-sectional view of a preferred embodiment of a contact-making system with the flat ribbon cable according to FIG. 1 and a connection collar.

A contact-making system 80 which is illustrated in section in FIG. 2 includes the flat ribbon cable 2 according to FIG. 1 and a tapping collar 86 which is constructed in two parts from a top part 92 and a bottom part 98. In the exemplary embodiment, the tapping collar is composed of polyamide. The top part 92 has a closure apparatus 104 with a hinged joint. On one side of the top part 92, the closure apparatus 104 includes a clip 108 which is in the form of a segment of a circle in cross section and which, in the assembled state of the tapping collar 86, accommodates a rib-like protrusion 110 of the bottom part 98 in order to form the hinged joint. The closure apparatus further includes a fastening device 116 on the opposite side of the tapping collar 86 in order to form the hinged joint, the fastening device being constructed in the exemplary embodiment as a fastening screw with which top part 92 and bottom part 98 are connected to one another in a releasable manner.

The top part 92 of the tapping collar 86 has a plurality of sleeves 122 which corresponds to the number of cores, it being possible for contact-making screws 128 which serve as contact-making devices to be screwed into the sleeves. When the respective contact-making screw 128 is screwed into the corresponding sleeve 122, initially the sheath 6 of the flat ribbon cable 2 and then the insulation 18 of the core 12 are pierced by a pointed screw end 134 as part of an insulation-piercing contact-making process, until the screw end 134 touches or pierces the core 12. The individual contact-making screws 128 each have associated lines 146 which make contact with or are brought into electrically conductive connection with that core 12 into which the respective screw end 134 has been inserted.

An arrow 150 identifies a deformation force $F_K$ which is exerted by the respective contact-making screw 128 when it is screwed into the sheath 6 of the flat ribbon cable 2. Due to the planar or flat construction of the top sheath face 24, the force is distributed uniformly over the sheath 6 when the respective contact-making screw 128 is screwed in, and a high level of reliability of the cores 12 is achieved. In the case of a corrugated construction of the top sheath face 24 which could then look similar to the bottom sheath face 30, a high level of impermeability of this kind would not be achievable. Finally, the illustration in FIG. 2 shows yet another portion of the sealing strip 140 which runs transverse to the longitudinal direction 54. The sealing strip 140 runs—as already stated—along the outer sheath faces 36, 42 in the longitudinal direction 54 and traverses the flat ribbon cable 2 at two points. In this way, a rectangular contact-making region is enclosed by the sealing strip 140. When the fastening devices 16, which are in the form of fastening screws, of the closure apparatus 104 are closed, the sealing strip 140 is pressed against the top face of the sheath 6 of the flat ribbon cable 2 at such a high pressure that all of the points at which contact is made are effectively sealed off.

The illustration in FIG. 2 also shows that the individual segments of a circle of the contour of the bottom sheath face 30, which contour is in the form of a segment of a circle, each lie in receiving recesses 112 in the bottom part 98 of the tapping collar 86. Each core 12 has, as it were, a separate associated receiving recess 112. The center longitudinal axes of the cores 12 and of the receiving recesses 112 run preferably congruently in order to effectively center the cores 12 in the tapping collar 86 and to increase the reliability of the contact-making screws 128 when contact is made with the cores 12.

Arrows 156 show the supporting forces $F_S$ of the tapping collar which act due to contact being made in the region of each core 12. Due to the shaping, which is constructed congruently with respect to shape to the respective region of the contour, which is in the form of a segment of a circle, of the bottom sheath face 30 in the region of the respective core 12 and the interlocking connection between bottom sheath face 30 and bottom part 98 which is possible as a result, the supporting forces $F_S$ act radially inward, and therefore the core 12 is held in its position and is not displaced during the contact-making operation or after it. A permanent and reliable contact-making connection is ensured in this way.

Figure 3:
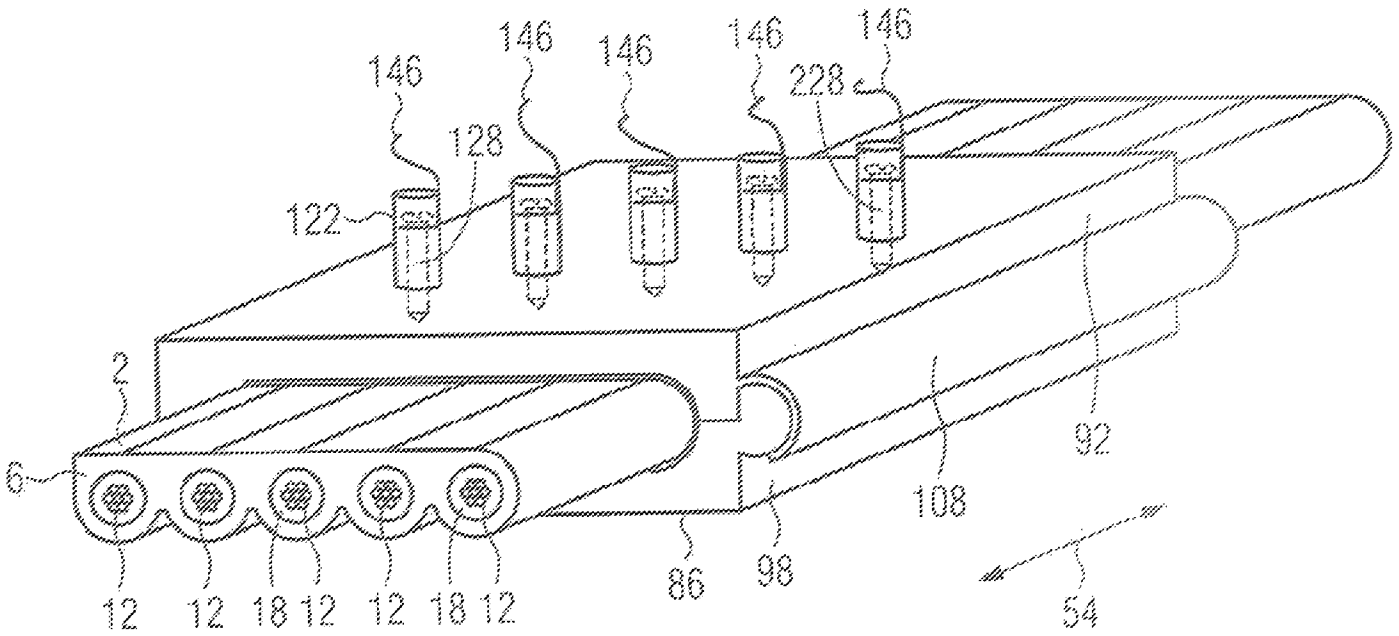
FIG. 3 is a highly-diagrammatic, perspective view of the contact-making system according to FIG. 2.

The contact-making system from FIG. 2 is shown in a perspective manner in FIG. 3. The figure shows the extent of the tapping collar 86 in the longitudinal direction 54 and also the spatial offset in this direction of the sleeves 122 and contact-making screws 128 in relation to one another. By virtue of this spatial configuration, the distances or spacings between the individual contact-making devices are increased in comparison to a configuration in which the contact-making screws would all be disposed in a direction perpendicular to the longitudinal direction 54. This also reduces the risk of a short circuit between two adjacent cores 12.

The invention claimed is:

1. An electrical contact-making system, comprising:

a flat ribbon cable having a sheath with a planar top sheath face, a core plane with electrical cores and a bottom sheath face with constrictions, said constrictions being parallel to said cores and each of said constrictions being disposed between a respective two of said cores;

a tapping collar configured to electrically contact said cores, said tapping collar having a top part facing said top sheath face of said flat ribbon cable, said top part having a bottom face; and a peripheral sealing strip disposed on said bottom face of said top part and enclosing a rectangular contacting region.

2. The contact-making system according to claim 1, wherein said flat ribbon cable has outer sheath faces, and said sealing strip runs parallel to said outer sheath faces and traverses said top sheath face of said flat ribbon cable at two spaced-apart points.

3. The contact-making system according to claim 1, wherein said bottom sheath face of said flat ribbon cable has a wave-form contour with wave troughs formed by grooves.

4. The contact-making system according to claim 1, wherein said flat ribbon cable has outer sheath faces with asymmetrical shaping forming mechanical coding.

5. The electrical contact-making system according to claim 1, wherein said cores of said flat ribbon cable are individually electrically insulated.

6. The contact-making system according to claim 5, wherein said tapping collar has a number of contact-making devices corresponding to a number of said cores, said contact-making devices configured to carry out an insulation-piercing contact-making process.

7. The contact-making system according to claim 1, wherein:

said tapping collar has a two-part construction including said top part and a bottom part;

said top part has a receiving region with a shape being congruent to said top sheath face; and said bottom part has a receiving region with a shape being congruent to said bottom sheath face.

8. The contact-making system according to claim 7, wherein said shapes of said top part and said bottom part are configured to cause said top part and said bottom part to receive said flat ribbon cable in an interlocking manner only in a defined position.

9. The contact-making system according to claim 7, wherein said bottom part has receiving recesses for said bottom sheath face, said receiving recesses each have a respective central longitudinal axis, and said cores each have a central longitudinal axis running parallel to said central longitudinal axis of a respective one of said receiving recesses.

10. The contact-making system according to claim 7, wherein said bottom part has receiving recesses for said bottom sheath face, said receiving recesses each have a respective central longitudinal axis, and said cores each have a central longitudinal axis being congruent with said central longitudinal axis of a respective one of said receiving recesses.

11. The contact-making system according to claim 7, which further comprises a closure apparatus configured to releasably fasten said top part and said bottom part to one another.

* * * * *